US005100005A

United States Patent [19]

Noble et al.

[11] Patent Number: 5,100,005

[45] Date of Patent: Mar. 31, 1992

[54] TRASH BAGS FOR RECYCLABLE ARTICLES AND SYSTEM AND METHOD FOR COLLECTING RECYCLABLE WASTE

[75] Inventors: John W. Noble; James Boule, both of St. Petersburg, Fla.

[73] Assignee: Plastics Recovery, Inc., St. Petersburg, Fla.

[21] Appl. No.: 392,665

[22] Filed: Aug. 11, 1989

[51] Int. Cl.[5] ..... B07C 5/34; B07C 9/00; B65D 30/06; B65D 33/00

[52] U.S. Cl. ..... 209/583; 206/459; 209/651; 209/699; 209/930; 220/908; 383/117; 383/126

[58] Field of Search ..... 209/3.3, 580, 583, 930, 209/933, 942, 699, 651-654; 220/1 T, 404, 908; 232/43.1, 43.2, 43.5; 312/211, 212; 383/117, 127; 206/459; 901/30

[56] References Cited

U.S. PATENT DOCUMENTS

| | | | |
|---|---|---|---|
| 3,446,351 | 5/1969 | Born | 209/583 X |
| 4,557,958 | 12/1985 | Barkis et al. | 383/127 X |
| 4,660,758 | 4/1987 | Tavel et al. | 232/43.2 |
| 4,750,639 | 6/1988 | Schaerer | 206/459 X |
| 4,764,668 | 8/1988 | Hayard | 235/470 |
| 4,764,879 | 8/1988 | Campbell | 364/482 |
| 4,949,528 | 8/1990 | Palik | 209/930 X |

FOREIGN PATENT DOCUMENTS

| | | | |
|---|---|---|---|
| 0652473 | 11/1962 | Canada | 383/117 |
| 0159309 | 10/1985 | European Pat. Off. | 383/127 |
| 2333146 | 4/1975 | Fed. Rep. of Germany | 209/583 |
| 3636310 | 4/1988 | Fed. Rep. of Germany | 220/1 T |
| 2132573 | 11/1972 | France | 901/30 |
| 1-13309 | 1/1989 | Japan | 209/580 |

*Primary Examiner*—Michael S. Huppert
*Assistant Examiner*—Edward M. Wacyra
*Attorney, Agent, or Firm*—Willian Brinks Olds Hofer Gilson & Lione

[57] ABSTRACT

A trash bag for recyclable waste which will eliminate a second collection of recyclables and having color or another type of code thereon to permit the bag to be identified and separated from trash bags containing ordinary trash, and a system and method for collecting recyclable waste. The trash bag is designed to be placed in the normal trash collection stream along with bags of ordinary trash and to be delivered to an existing landfill or incinerator or to another separation location at which identification and separation of the bags from the bags of ordinary trash is accomplished. According to the invention, identification and separation of the bags of recyclable trash can be performed manually or in an automated manner at the landfill, incinerator, or other separation location.

6 Claims, 1 Drawing Sheet

TRASH BAGS FOR RECYCLABLE ARTICLES AND SYSTEM AND METHOD FOR COLLECTING RECYCLABLE WASTE

TECHNICAL FIELD

The present invention relates to a trash bag for recyclable articles, and to a system and method for collecting recyclable waste whereby recyclable waste is placed in the normal trash collection stream and is separated from other solid waste during the trash collection process.

BACKGROUND ART

It is well-known that many waste products are recyclable; that is, they can be reprocessed into new products at a small fraction of their original cost of manufacture. This results in substantial savings to both the manufacturer and the consumer and significant conservation of valuable natural resources.

A substantial quantity of recyclable waste, for example, aluminum cans, glass, various plastic articles, paper, etc., is generated by the homeowner, and the homeowner usually disposes of this waste by placing it into trash cans or bags along with his ordinary trash to be picked up and disposed of by a municipal or private trash collection agency. Because the recyclable waste is mixed in with ordinary trash, separation of the recyclable articles from the ordinary trash is difficult, and the recyclable waste is usually disposed of by the collection agency either by being incinerated or deposited into a landfill along with the ordinary trash.

Procedures are available whereby a homeowner can separate his recyclable waste from ordinary trash. Typically, however, the homeowner must further separate different types of recyclable waste from one another and either deliver the separated waste to specific collection points or have them separately picked-up. This is an inconvenient and time-consuming chore and most homeowners do not practice this procedure.

SUMMARY OF THE INVENTION

The present invention provides a trash bag for recyclable articles which includes coding means thereon to permit the bag to be readily identified and distinguished from bags of ordinary trash. In addition, the present invention provides a recyclable waste collection system and method whereby recyclable waste is delivered into the normal trash collection stream and separated from ordinary trash during the collection process.

A trash bag according to the present invention is comprised of a material that is able to withstand compaction and other pressures exerted on it during the normal trash collection process without breaking or tearing, and includes coding means thereon which can be readily detected either visually or in an automated manner to permit the bag to be separated from ordinary trash.

In accordance with a presently preferred embodiment, the coding means comprises bar code means printed or otherwise placed on the outer surface of the bag and readable by a scanner to permit the bag to be readily identified among bags of ordinary trash. To insure that the scanner is able to detect the bar code means on the bag irrespective of the orientation of the bag, the bar code means preferably comprises a plurality of identical bar codes placed at a plurality of locations on the outer surface of the bag; and most preferably comprises a plurality of identical, closely spaced bar codes arranged in a ring which extends around the circumference of the bag adjacent the bottom end thereof.

To ensure that the bag is able to withstand the pressures exerted during the normal trash collection process, the bag is preferably made of a woven fabric material such as woven polypropylene fabric or another woven plastic fabric of similar characteristics. Bags formed of such materials are able to be compacted without bursting and pierced without tearing and retain their integrity throughout the trash collection process.

According to the present invention, a homeowner places trash bags filled with recyclable waste into the normal trash collection stream to be picked-up by a municipal or private trash collection agency along with bags of ordinary trash. The collection agency delivers all of the collected trash bags to a separate location where the bags filled with recyclable waste are identified and separated from the bags filled with ordinary waste.

In accordance with one aspect of the invention, the trash bags filled with recyclable waste can be identified visually by the coding means thereon and separated manually. According to an alternative aspect, the bags filled with recyclable waste can be both identified and separated in an automated recyclable waste separation system.

For visual monitoring, the coding means on the bags can comprise the bar code means described above, a color identification code or some other visually distinctive coding means. In one embodiment of an automated recyclable waste separation system, the coding means can comprise a machine-readable coding means such as the bar code means described above, and the system can include a conveyor to convey all the collected trash bags along a conveying path, a scanner for scanning the collected trash bags as they move along the conveyor and to read the bar code means thereon to identify the bags filled with recyclable waste, and mechanical separating means connected to the scanner for separating the identified trash bags containing recyclable waste from the collected trash bags.

Because the bar code means is applied to the surface of the bags at a plurality of locations, substantially all bags having recyclable waste will be identified. The mechanical separating means can take various forms but preferably comprises a robot arm that extends into or through the bag and removes it from the conveyor.

In an alternative embodiment of an automated system, separation can be accomplished by hooking, gaffing, tumbling, etc. all the collected trash bags. When handled in such a manner, conventional trash bags will tear and their contents spill while the trash bags of the present invention will retain their integrity. In such an embodiment, the strength of the trash bags of the invention functions as the coding means to identify them from conventional trash bags.

Further advantages and specific details of the invention will be set forth hereinafter in conjunction with the following detailed description of a presently preferred embodiment.

BEST MODES FOR CARRYING OUT THE INVENTION

Figure 1:
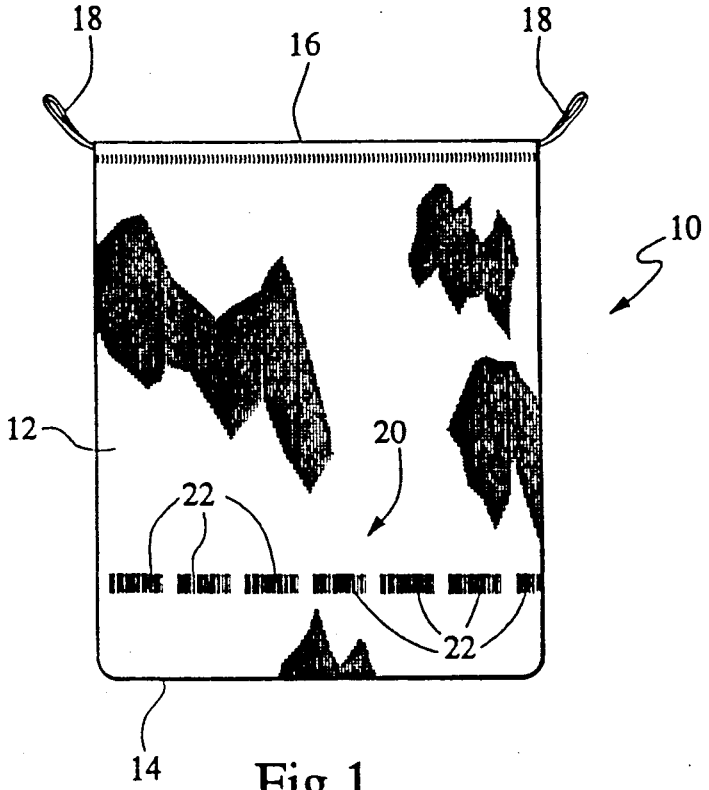
FIG. 1 illustrates a trash bag for recyclable articles according to a presently preferred embodiment of the invention.

FIG. 1 illustrates a trash bag for recyclable articles according to a presently preferred embodiment of the invention. The trash bag is generally designated by reference number 10 and is of substantially the same size and shape as conventional plastic trash bags although it is not intended to limit the invention to any particular size. Bag 10 includes a side wall 12 defining the circumference of the bag, a closed bottom end 14 and an open top end 16 through which articles are adapted to be placed into the bag. Closure means such as drawstrings 18 can be provided on the bag to close the bag after it has been filled, or alternatively, the bag can be closed with a twist tie or in any other desired manner.

As will be explained hereinafter, bag 10 is designed to be filled with recyclable waste articles such as aluminum cans, glass bottles, various plastic articles, and the like, and placed into the normal trash collection stream. Accordingly, bag 10 is preferably constructed of a material that will reliably retain such articles without breaking or tearing notwithstanding the pressures that are likely to be exerted on it during the normal trash collection process.

Presently preferred materials for constructing bag 10 are woven fabrics such as woven plastic fabrics. A presently most preferred material is woven polypropylene fabric or another woven plastic fabric of similar strength characteristics formed in a relatively close weave, for example a #10 weave. Bags 10 formed of such materials are able to maintain their integrity notwithstanding the substantial pressures put on it during the normal trash collection process. For example, any piercing of the bag caused by jagged glass or the like in the bag will be prevented from expanding into a large tear by the woven strands of the fabric. Also, compaction of the bag by the trash pick-up truck will not cause the bag to burst because the fabric material is able to breathe, that is, weaker points between the woven strands will pop allowing air to escape, thus permitting the bag to maintain its integrity.

Bag 10 also includes coding means 20 on the outer surface thereof to permit the bag to be identified and distinguished from bags of ordinary trash. In a presently preferred embodiment, coding means 20 comprises a plurality of identical bar codes 22 printed or otherwise applied on the outer surface of the side wall 12 and arranged as a ring of spaced bar codes extending around the circumference of the bag adjacent the bottom end 14 thereof. The plurality of bar codes 22 are spaced from one another by about one-half inch and are identical as will be explained hereinafter, to permit a scanner to read a bar code thereon irrespective of the orientation of the bag.

Trash bag 10 is designed to be used by homeowners and others as a convenient means for disposing of their recyclable waste. In particular, it is contemplated that a homeowner will place solid recyclable waste materials such as aluminum cans, glass bottles, various plastic articles and the like into bag 10. When bag 10 is filled, it is closed and placed in the normal trash collection stream to be picked up by a private or municipal trash collection agency along with the homeowner's ordinary trash. The trash collection agency will then deliver all the collected bags to a separation location at which the bags of recyclable waste are identified by the coding means thereon and separated from the bags of ordinary trash prior to the disposal of the ordinary trash.

Figure 2:
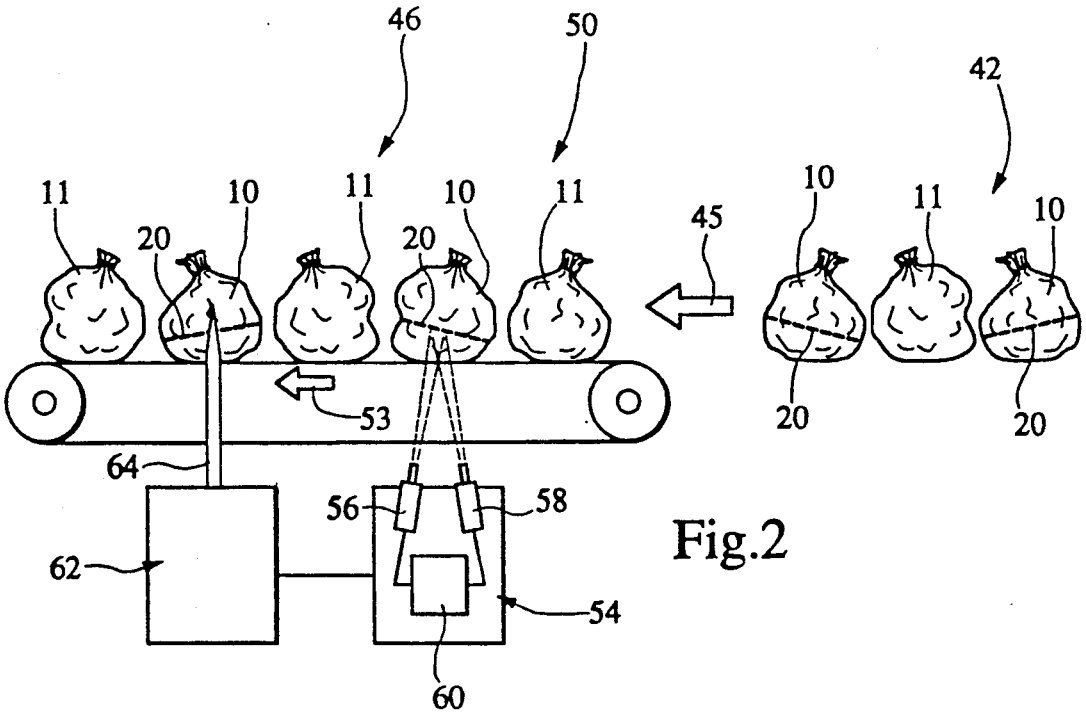
FIG. 2 schematically illustrates a system and method for collecting recyclable waste according to a further aspect of the present invention.

FIG. 2 schematically illustrates a system and method for collecting recyclable waste according to a presently preferred embodiment of the invention. As shown in FIG. 2, trash bags 10 filled with recyclable articles and conventional trash bags 11 filled with ordinary trash are placed by a homeowner at his usual trash pick-up location 42 to be picked-up by a private or municipal trash collection agency in the usual manner by a trash collection truck. The collected bags 10 and 11 are delivered by the truck, as indicated by arrow 45 to a separation location 46 (which may be conveniently located at the collection agency's trash disposal facility) at which the bags 10 of recyclable waste are identified by the coding means thereon and separated from the bags 11 filled with ordinary trash so that they may be later collected for reprocessing.

Identification of bags 10 at separation location 46 can be done visually by viewing the coding means thereon, and separation of the identified bags 10 can be done manually. Such a process may be suitable in small towns or the like where the volume of collected trash is relatively small. When identification is done visually, the coding means can be the bar code means 20 illustrated in FIG. 1, or another visually perceptible coding means. For example, bag 10 can be provided with color coding means in which all or a portion of the bag is provided in a distinctive color. Also, a readily identifiable design or other indicia can be placed on the bag to permit quick visual identification.

Identification and separation of bags 10 from bags of ordinary trash can also be done in a fully automated manner as might be preferred in larger cities where large quantities of trash must be processed and the trash collection agencies are equipped with factory-type machinery for trash disposal.

FIG. 2 also illustrates an automated system 50 for collecting recyclable waste according to a preferred embodiment of the invention. System 50 is located at separation location 46 and includes conveyor means such as a conveyor belt 52 upon which all collected trash bags including bags 10 and 11 are placed. As bags 10 and 11 travel along conveyor belt 52 in the direction of arrow 53, they pass beneath an electronic scanner 54 of generally conventional type which is capable of "reading" the bar codes on bags 10. As is known to those skilled in the art, scanner 54 includes one or more light sources 56 for directing light toward the trash bags on conveyor belt 52, a receiver 58 for receiving light reflected from the trash bags, and an image processor 60 for processing the reflected light and for "reading" the bar codes on the bags to identify the bags 10 of recyclable waste on the conveyor belt.

By providing a plurality of identical bar codes at spaced locations on bag 10, scanner 54 will reliably identify substantially all of the bags 10 on the conveyor belt irrespective of their orientation on the belt. It has been found that a plurality of closely spaced bar codes arranged in a ring around the circumference of the bag adjacent the bottom end thereof is satisfactory to permit the scanner to identify substantially all bags 10 on the conveyor belt.

Scanner 54 is connected to a separating means 62 positioned adjacent the conveyor belt 52 downstream of the scanner. Separating means 62 can take numerous forms but preferably comprises one or more robot arms 64 designed to pick up and remove the identified bags 10 of recyclable waste from the conveyor belt. For example, robot arm 64 can conveniently comprise a movable arm having a pointed end that is designed to pierce the side walls of bags 10 and extend into or through the bags to permit them to be reliably picked up and removed from the conveyor belt. Because of the woven plastic fabric construction of the bags, piercing of a bag by the robot arm will not cause the bag to tear to an extent that its contents are able to spill therefrom. Separating means 62 can also comprise a trap door through which identified bags 10 are allowed to fall, a hook to pick up the bags or any other suitable separating structure.

With system 50, bags 10 filled with recyclable waste on conveyor belt 52 are automatically identified by scanner 54. When a bag 10 is identified, scanner 54 sends a signal to separating means 62 which automatically removes the identified bag 10 from the conveyor belt.

Identification of bags 10 can also be achieved due to the nature or strength of the bags. For example, all collected bags can be picked up by a hook, gaffed, tumbled or similarly handled. When handled in such a manner, ordinary trash bags will tear and spill their contents while bags 10 of the present invention will retain their integrity. In such embodiments of the invention, the strength of bags 10 function as coding means to identify and distinguish them from ordinary bags.

With the present invention, a system and method is thus provided whereby bags of recyclable waste are placed into the ordinary trash collection stream, identified by coding means thereon and separated from the bags of ordinary trash before its disposal to permit the recyclable waste to be recovered for future use.

While what has been described constitutes presently preferred embodiments of the invention, it should be recognized the invention could take numerous other forms. For example, as indicated above, the coding means on the trash bag can take numerous forms. Also, if desired, bags having different codes thereon can be provided to permit presorting of different types of recyclable waste. For example, differently coded bar codes can be provided on different bags to permit different types of recyclable waste to be separated from one another during the separation process. Such bags will preferably also be of different colors or the like to permit the homeowner to readily distinguish between them. Because the invention can take numerous forms, it should be understood that the invention is to be limited only insofar as is required by the scope of the following claims.

We claim:

1. A flexible trash bag for recyclable waste articles, said flexible trash bag having a plurality of identical bar codes thereon to enable said trash bag to be automatically identified and separated from bags containing ordinary trash, said plurality of identical bar codes comprising a plurality of identical spaced bar codes arranged in a ring on the outer surface of said trash bag around the circumference thereof.

2. The flexible trash bag of claim 1 wherein said trash bag is constructed of a woven fabric material woven in a relatively close weave.

3. The flexible trash bag of claim 1 wherein said bag comprises a top end and a bottom end, and wherein said plurality of identical spaced bar codes is arranged in a ring around the circumference of said bag adjacent the bottom end thereof.

4. An automated system for collecting recyclable waste comprising:

a trash bag adapted to be filled with recyclable waste, said trash bag being constructed of a woven fabric material having coding means thereon;

conveyor means for conveying said trash bags filled with recyclable waste and trash bags filled with ordinary trash;

a scanner for scanning all of said trash bags on said conveyor means and for automatically reading said coding means on said trash bags filled with recyclable waste for identifying said trash bags filled with recyclable waste; and separating means connected to said scanner for separating said identified trash bags filled with recyclable waste on said conveyor means from said trash bags filled with ordinary trash, wherein said separating means includes a movable robot arm having a pointed end for piercing said identified trash bags filled with recyclable waste and for extending into or through said trash bags filled with recyclable waste.

5. The system of claim 4 wherein said coding means comprises a plurality of identical bar codes positioned at a plurality of spaced locations on an outer surface of said trash bag.

6. A method for collecting recyclable waste comprising:

collecting, during the normal trash collection of a municipal or private trash collection agency, bags filled with recyclable waste and bags filled with ordinary trash at one or more collection locations, said bags filled with recyclable waste being constructed of a woven fabric material and having coding means comprising the strength of said woven fabric material;

delivering said collected bags to a separation location;

identifying said bags filled with recyclable waste by said coding means at said separation location; and separating said identified bags filled with recyclable waste from the remainder of said collected bags, said identifying step and said separating step comprising piercing said bags filled with recyclable waste and said bags filled with ordinary trash, whereby said bags filled with recyclable waste will retain their integrity and said bags filled with ordinary trash will tear and spill their contents.

* * * * *